US007256810B2

(12) United States Patent
Göttling et al.

(10) Patent No.: US 7,256,810 B2
(45) Date of Patent: Aug. 14, 2007

(54) APPARATUS FOR PRODUCING A PRINTING IMAGE BY MEANS OF A LASER

(75) Inventors: Josef Göttling, Friedberg (DE); Thomas Hartmann, Mering (DE)

(73) Assignee: MAN Roland Druchmaschinen, Augsburg (DE)

( * ) Notice: Subject to any disclaimer, the term of this patent is extended or adjusted under 35 U.S.C. 154(b) by 300 days.

(21) Appl. No.: 11/117,415

(22) Filed: Apr. 29, 2005

(65) Prior Publication Data

US 2005/0241515 A1 Nov. 3, 2005

(30) Foreign Application Priority Data

Apr. 30, 2004 (DE) ..... 10 2004 021 494

(51) Int. Cl.
*B41J 2/435* (2006.01)

(52) U.S. Cl. ..... 347/224

(58) Field of Classification Search ..... 347/198, 347/224–225, 262, 264; 101/216; 248/657–658
See application file for complete search history.

(56) References Cited

U.S. PATENT DOCUMENTS 4,119,032 A * 10/1978 Hollis ..... 101/216
6,186,068 B1 2/2001 Gelbart
6,249,300 B1 * 6/2001 Kerr et al. ..... 347/198
6,792,858 B2 9/2004 Kolbe et al.
2003/0090731 A1 5/2003 Knopf

FOREIGN PATENT DOCUMENTS

DE 198 45 711 A1 6/2000
EP 0 962 316 A 12/1999

* cited by examiner

*Primary Examiner*—Hai Pham
(74) *Attorney, Agent, or Firm*—24IP Law Group; Timothy R. DeWitt

(57) ABSTRACT

In an apparatus for producing a printing image on a printing medium held by a cylinder (1) by a laser, the laser writing head (7) of which is positioned on a crossmember (3) so as to be displaceable parallel to the axis of the cylinder (1), a space-saving functionally reliable embodiment is attained by the fact that a protective switch (10) which detects the presence of a cylinder (1) is provided fixedly on the crossmember (3) and the crossmember (3) bears switching strips (5, 6) which expose a laser writing head displacement region (b) between them having the width of the printing image (8) and interact with a further protective switch (11) attached to the laser writing head (7) for switching off the laser when it is situated outside the laser writing head displacement region (b).

8 Claims, 1 Drawing Sheet

APPARATUS FOR PRODUCING A PRINTING IMAGE BY MEANS OF A LASER

CROSS-REFERENCE TO RELATED APPLICATIONS

This application claims priority under 35 U.S.C. § 119 to German application number 10 2004 021 491.3, filed 30 Apr. 2004, the entirety of which is incorporated by reference herein.

STATEMENT REGARDING FEDERALLY SPONSORED RESEARCH OR DEVELOPMENT

Not applicable.

BACKGROUND OF THE INVENTION

Field of the Invention

The invention relates to an apparatus for producing a printing image on a printing medium held by a cylinder by means of a laser, the laser writing head of which is positioned on a crossmember so as to be displaceable parallel to the axis of the cylinder.

SUMMARY OF THE INVENTION

The present invention disclosed and claimed herein is an apparatus for producing a printing image on a printing medium held by a cylinder by means of a laser. The laser writing head is positioned on a crossmember so as to be displaceable parallel to the axis of the cylinder. The apparatus ensures that the laser is only operationally ready when there is a cylinder in front of the laser writing head and the laser writing head is in the region of the printing image which is to be applied.

A preferred embodiment of the present invention further has a protective switch that detects the presence of a cylinder. The protective switch is provided fixedly on the crossmember. The crossmember bears two switching strips which expose a laser writing head displacement region between them having the width of the printing image. The two switching strips interact with a further protective switch attached to the laser writing head for switching off the laser when it is situated outside the laser writing head displacement region. Some of the otherwise necessary, cumbersome protective measures can be dispensed with as a consequence of the working region of the laser writing head being secured directly in this manner.

In one embodiment, the invention comprises an apparatus useful for producing a printing image via a laser on a printing medium, which is held by a cylinder having an axis. The apparatus comprises a crossmember, a laser writing head positioned on the crossmember so as to be displaceable parallel to the axis of the cylinder, a first protective switch fixedly positioned on the crossmember and configured and arranged to detect the presence of a cylinder, two switching strips on the crossmember for exposing a laser writing head displacement region therebetween having a width of the printing image, and a second protective switch attached to the laser writing head configured and arranged to switch off the laser when the laser is situated outside the laser writing head displacement region. The two switching strips and the second protective switch are mutually configured and arranged so that the second protective switch interacts with the two switching strips. The second protective switch may comprise a mechanically actuated switch. The first protective switch may be configured and arranged to sense without contact, to scan a region of the cylinder outside the printing image, or to interact with a terminating flange of the cylinder. The switching strips may comprise ends which face the free intermediate space between the switching strips including oblique run-up edges for the second protective switch.

Further features and advantages emerge from the description of an exemplary embodiment using the drawing.

Still other objects, features, and attendant advantages of the present invention will become apparent to those skilled in the art from a reading of the following detailed description of embodiments constructed in accordance therewith, taken in conjunction with the accompanying drawing.

BRIEF DESCRIPTION OF THE DRAWINGS

The invention of the present application will now be described in more detail with reference to exemplary embodiments of the apparatus and method, given only by way of example, and with reference to the accompanying drawing (FIG. 1), which illustrates parts of an exemplary image-setting apparatus in accordance with the present invention, in a view from above.

DETAILED DESCRIPTION OF EXEMPLARY EMBODIMENTS

Figure 1:
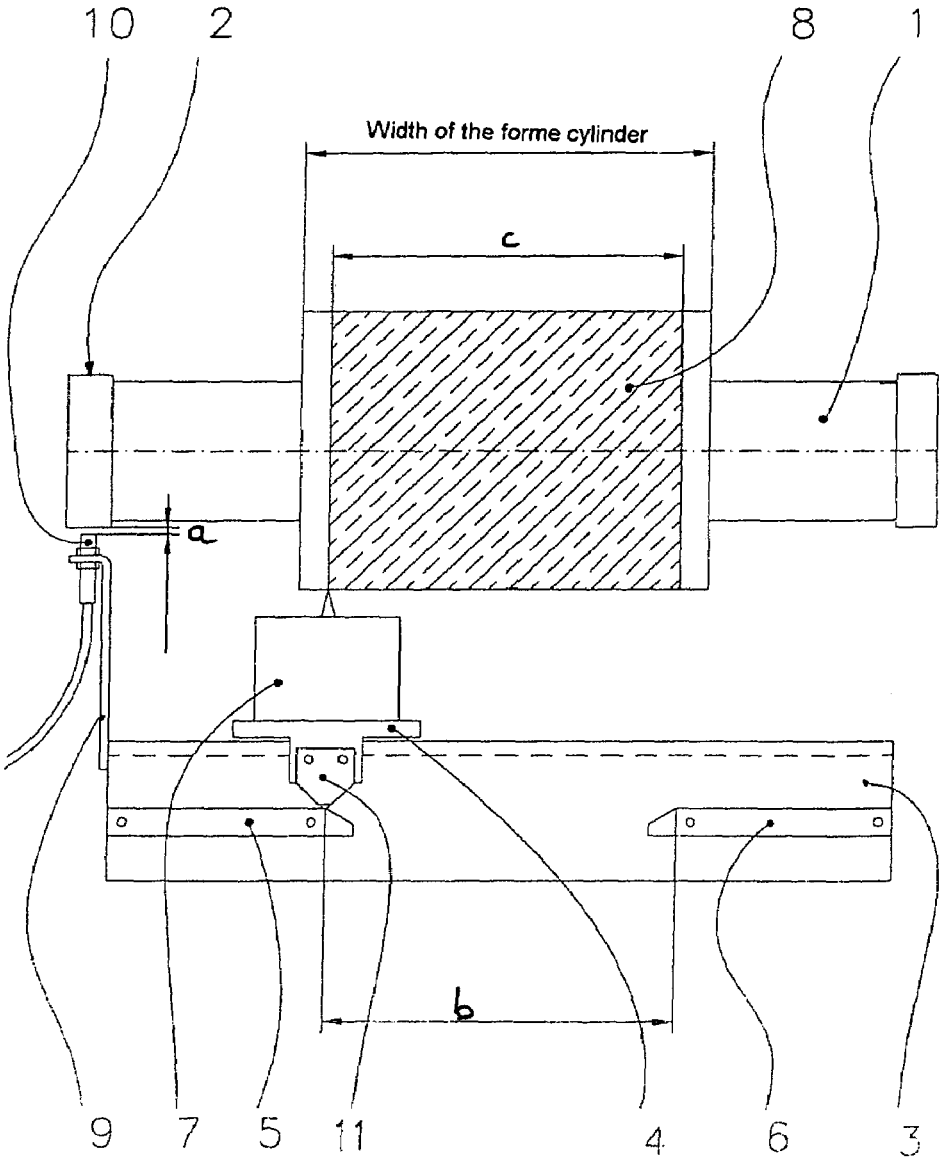

As shown in FIG. 1, a preferred embodiment of the invention has a cylinder 1 with at least one terminating flange 2. A printing forme which can have an image set on it (but is not denoted explicitly here) is pushed onto the cylinder 1, in particular an erasable printing forme (or sleeve) which is to be provided with a printing image 8.

A crossmember 3 is arranged parallel to the cylinder 1, on which crossmember 3 a laser writing head 7 is guided by means of a carriage 4. The laser writing head 7 is displaceable parallel to the axis of the cylinder 1.

A support 9 for a protective switch 10 is attached fixedly to the crossmember 3. The protective switch 10 is configured as a switch which senses the terminating flange 2 without contact. It prevents the laser from being switched on when the cylinder 1 is not in the position provided for image-setting, that is to say there is no terminating flange 2 at the spacing a. The cylinder 1 can also directly take the position of the terminating flange 2. As a result of the fact that the protective switch 10 scans a region of the cylinder 1 outside the printing image 8, this scanning is used independently of the cylinder diameter and advantageously with variable formats with regard to the cylinder diameter.

A further or second protective switch 11 is attached to the carriage 4 of the laser writing head 7. The protective switch 11 interacts with two switching strips 5, 6 which are positioned fixedly on the crossmember 3. Here, the switching strips 5 and 6 expose a laser writing head displacement region between them which corresponds to the width c of the printing image 8 which is to be applied. The protective switch 11 is configured as a switch which is actuated mechanically by running onto the switching strips 5, 6, but can also be configured as a contactless switch in an analogous manner to the protective switch 10.

If the protective switch 11 is in the (exposure) region b, the laser can operate, under the proviso that the protective switch 10 has detected a cylinder 1 situated correctly in the working position. If, however, the protective switch 11 runs over the bevelled portions of the switching strips 5, 6 onto that end face of the switching strips which faces the laser writing head 7, and thus leaves the region b, the laser is switched off, with the result that the entire arrangement is also suitable as a personal protection means.

As described above, the invention attains a space-saving functionally reliable apparatus. The invention is not restricted to the application in an image-setting station which is separated from the printing press, but can also be used in apparatuses with which the impression cylinder has images set on it in the printing press.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An apparatus useful for producing a printing image on a printing medium held by a cylinder by a laser, the cylinder having an axis, the apparatus comprising:

a crossmember;

a laser writing head positioned on the crossmember so as to be displaceable parallel to the axis of the cylinder;

a first protective switch configured and arranged to detect the presence of a cylinder, the first protective switch being fixedly positioned on the crossmember;

two switching strips on the crossmember which strips expose a laser writing head displacement region therebetween having a width of the printing image; and a second protective switch attached to the laser writing head configured and arranged to switch off the laser when the laser is situated outside the laser writing head displacement region;

wherein the two switching strips and the second protective switch are mutually configured and arranged so that the second protective switch interacts with the two switching strips.

2. An apparatus according to claim 1, wherein the first protective switch is configured and arranged to sense without contact.

3. An apparatus according to claim 2, wherein the second protective switch comprises a mechanically actuated switch.

4. An apparatus according to claim 1, wherein the second protective switch comprises a mechanically actuated switch.

5. An apparatus according to claim 1, wherein the first protective switch is configured and arranged to scan a region of the cylinder outside the printing image.

6. An apparatus according to claim 5, wherein the first protective switch is configured and arranged to interact with a terminating flange of the cylinder.

7. An apparatus according to claim 1, wherein the switching strips comprise ends which face the free intermediate space between the switching strips including oblique run-up edges for the second protective switch.

8. An apparatus for producing a printing image on a printing medium comprising:

a cylinder for holding said printing medium, said cylinder having an axis;

a crossmember;

a laser comprising a laser writing head positioned on the crossmember so as to be displaceable parallel to said axis of said cylinder;

a first protective switch positioned on said crossmember for detecting the presence of said cylinder;

two switching strips on said crossmember for exposing a laser writing head displacement region therebetween having a width of the printing image; and a second protective switch attached to said laser writing head configured and arranged to switch off said laser when said laser is situated outside said laser writing head displacement region;

wherein said second protective switch interacts with said switching strips.

* * * * *